United States Patent [19]

Craig

[11] Patent Number: 4,772,156

[45] Date of Patent: Sep. 20, 1988

[54] TELESCOPING AUGER CONSTRUCTION FOR PAVING MACHINES

[75] Inventor: Andrew E. Craig, Shelbyville, Ill.

[73] Assignee: White Consolidated Industries, Inc., Ohio

[21] Appl. No.: 40,091

[22] Filed: Apr. 20, 1987

[51] Int. Cl.[4] ..... E01C 19/12

[52] U.S. Cl. ..... 404/101; 404/104

[58] Field of Search ..... 404/96, 101, 102, 104, 404/105, 106; 198/660

[56] References Cited

U.S. PATENT DOCUMENTS 2,845,167 7/1958 Heiken ..... 198/660

3,015,258 1/1962 Apel et al. ..... 404/106

3,605,995 9/1971 Maack ..... 198/660

FOREIGN PATENT DOCUMENTS 727533 4/1980 U.S.S.R. ..... 198/660

*Primary Examiner*—Jerome Massie

*Assistant Examiner*—Matthew Smith

*Attorney, Agent, or Firm*—Alfred E. Miller

[57] ABSTRACT

A powered telescoping auger in which the paddle elements or deflector plates are provided with rectangular, channel shaped castings which fit over complementary rectangular support tubes, and have tongue and groove interconnections. The castings have bolt means for removably attaching each paddle element to the support tubes.

7 Claims, 4 Drawing Sheets

TELESCOPING AUGER CONSTRUCTION FOR PAVING MACHINES

The present invention relates to a telescoping auger for asphalt paving apparatus used in conjunction with a power extendible screed of the type shown in my co-pending application Ser. No. 907,655, filed Sept. 15, 1986, U.S. Pat. No. 4,749,304.

My co-pending application describes the construction and advantage of using a power telescoping auger, together with, or independently of, a power variable floating screed in order to increase the paving mat to various widths depending upon the width of the road bed to be paved. Thus, the asphalt is delivered to a rotating auger-like distribution means which is positioned directly in front of an extendible screed so that the paving material, such as hot asphalt, is distributed laterally in a more or less uniform manner to the full paving width desired.

My co-pending application shows and describes the telescoping auger which can be controlled by the operator to vary the width of the paving mat as opposed to the use of auger extensions that have been, in the past, added to the fixed auger in order to extend the paving mat to the required width. However, the telescoping auger shown in my co-pending application discloses four quadrants of helically configured deflector segments, or paddles, in which pairs of paddles are arranged on separate telescoping shafts. It should be noted that the paddle sections are welded onto telescoping rails and, thus, cannot be replaced readily.

It is an object of the present invention to provide four quadrants of flighting to form a helical configuration which are removably secured to telescoping rails so that individual flight members or quadrants can be removed and replaced upon breakage without necessitating a substitution of an entire telescoping auger section.

It is the further object of the present invention to provide paddle sections which are provided with rectangular channel connector castings which fit into square tube paddle carrying sections by a tongue and groove arrangement, and can be bolted thereto.

It is still another feature of the present invention to provide replaceable paddle elements on telescoping auger sections, having fastening channels which are interconnected to other channel sections on a telescoping auger arrangement.

Another object of the present invention is to provide an outer support bearing with a bearing housing which is located at the extreme outer end of the telescoping auger assembly, so that when the auger is fully extended it is not necessary to push the paving material laterally out past the bearing and its housing in order to get the full width paving mat. In the past, the regular auger had its outer bearing positioned about one foot inward from the extreme outer end.

The present telescoping auger is especially advantageous when utilized with a power extendible screed so that the operator, during operation, can alter the paving width, as well as the configuration, as desired. There is no requirement that the operation of the paving apparatus be halted while the operator makes changes or adjustments to either or both the auger and the screed.

In order that the present invention may be more clearly understood, it will now be disclosed in greater detail with reference to the accompanying drawings wherein.

Figure 1:
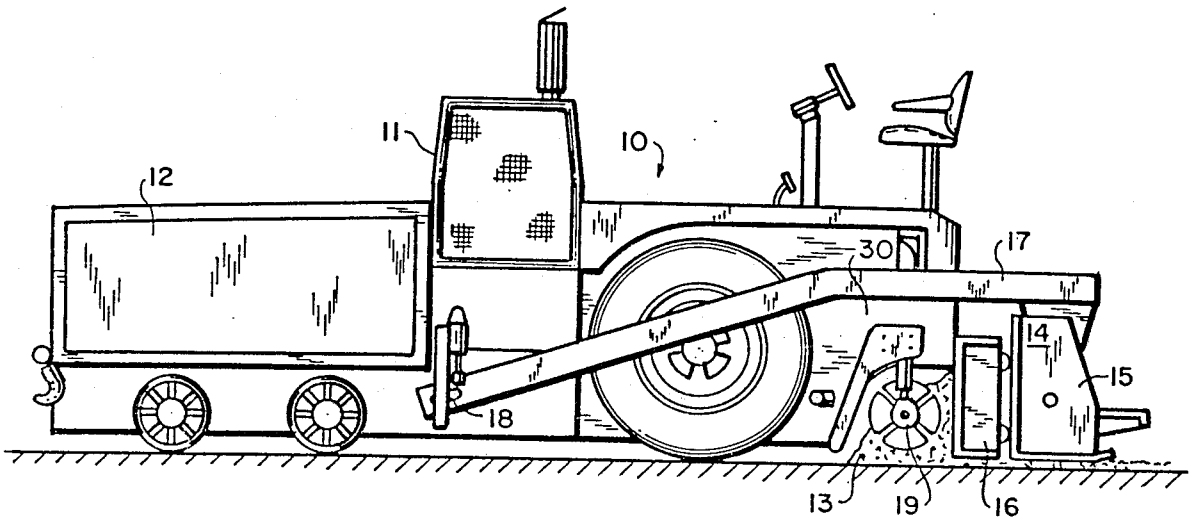
FIG. 1 is a diagrammatic side elevational view of an asphalt paver machine having a floating screed and a power extendible material distributor mechanism according to the present invention.

In FIG. 1 the reference numeral 10 is used to designate a typical form of an asphalt paving machine having a floating screed and incorporating the present invention directed to a telescoping distribution mechanism. The asphalt paver is self-propelled by an engine 11 and is provided at its forward end with a load carrying hopper 12 for receiving hot asphalt paving material from a dump truck typically positioned directly in front of the paver. In operation, the paver pushes the truck along the road bed with the truck continually discharging paving material into the hopper 12. The conventional paver includes an internal conveyor means (not shown) which conveys the hot asphalt material in a rearward direction depositing it at the back of the paver as indicated by the reference numeral 13.

The paver apparatus includes a power extendible screed 14 which includes a center screed section 15 and, on opposite sides, laterally extendible screed elements 16 which are attached to the paver by means of tow arms 17 on each side of the paver. It will be noted that the tow arms are attached to the paver at tow points 18 which are vertically adjustable such that the angle of attack of the floating screed assembly 14 may be controllably varied during paving to maintain a level paving surface. The power extendible screed structure may be constructed in accordance with the teachings of U.S. Pat. No. 4,379,653 to Brown.

Located directly in front of the screed 14 is an auger-like material distributor mechanism 19 which forms the basis of the present invention. Asphalt material deposited by the conveyor means accumulates in a pile in front of the screed in a relatively narrow area determined by the width of the conveyor means. The distributor mechanism 19 is shown in the form of a rotating auger-like device which functions to distribute the paving material 13 laterally outward toward the end extremities of the screed. In a typical construction, an asphalt paver includes left and right side distributor mechanisms arranged to distribute the paving material outward in both directions from the center of the paving machines. However, in accordance with the present invention, the material distributor mechanism 19 by being telescopically extendible laterally, such as during paving, the length of the distributors may at all times properly correspond with the extended width of the screed 14.

Referring to FIGS. 2–9, there are shown details of construction of a power extendible distributor mechanism used in a paver of the type illustrated in FIG. 1, and described hereinbefore. As seen in FIGS. 2–5, the rotating distributor mechanism referred to generally by the numeral 20 includes inboard and outboard telescoping distributor sections referred to generally by the numerals 22 and 24, respectively. The inboard distributor section 22 comprises a series of three rectangular-shaped structural members 26, 28 and 30 arranged in side by side relation and secured together by welds to form a unitary structure. At its inboard end this assembly is attached to a drive mechanism (not shown) through which the inboard section is rotated. Mounted on outer tubular members 26 and 30 are deflector plates or paddles 32, 34, respectively. It should be evident that the plate 32, 34 is a full length auger paddle while plate 35 is a kickback paddle. The paddles 32, 34 are positioned in staggered relation along the length of the inboard section and rotationally displaced by 180 degrees, thus, when assembled, the deflector plates formed diametrically opposed 90 degree segments of a circular structure, the center of which is coincident with the axis of the center tube member 28, which is also the rotational axis of the distributor assembly.

Figure 2:
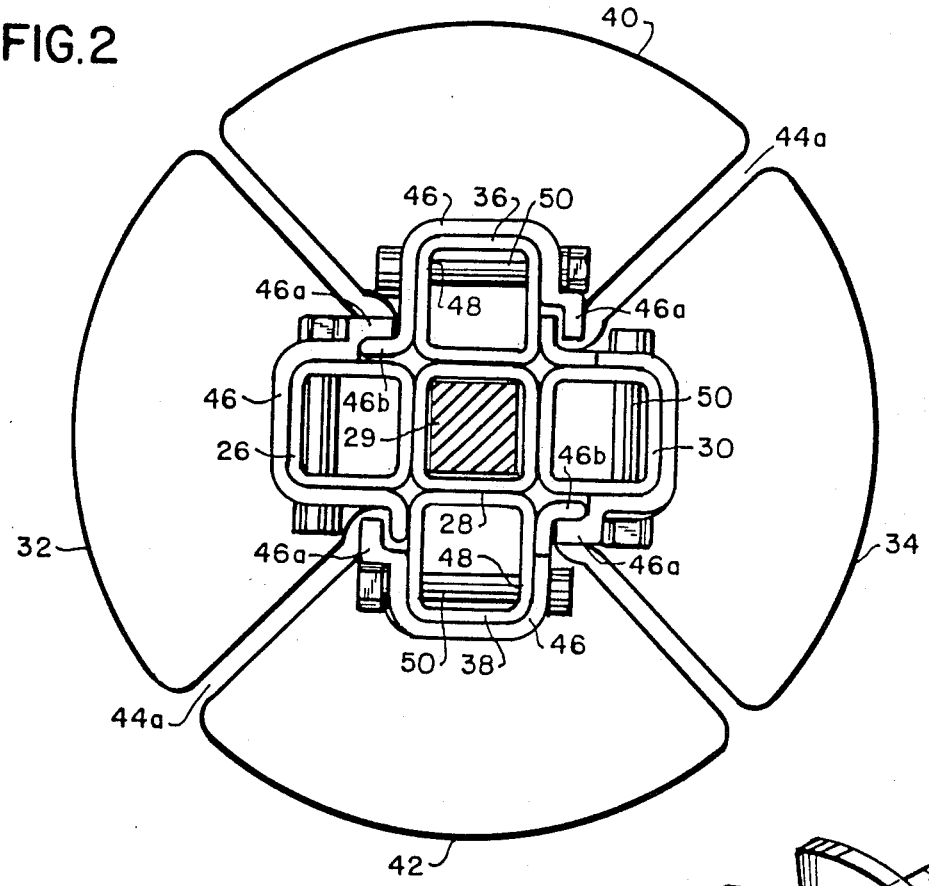
FIG. 2 is an enlarged cross sectional view showing an extendible distributor mechanism for a paving machine.
Figure 3:
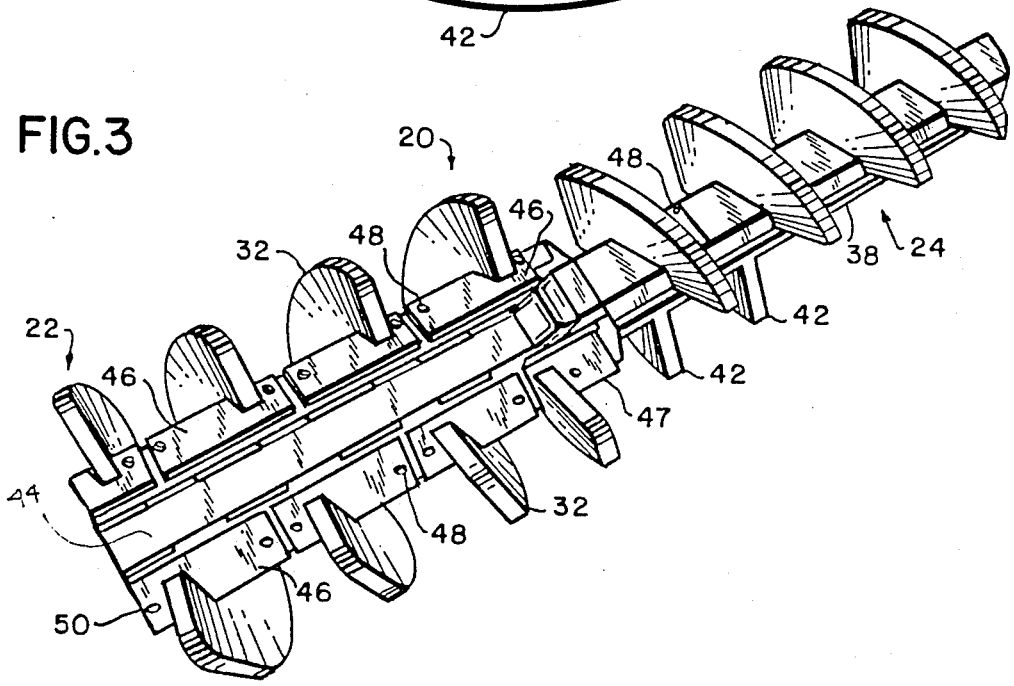
FIG. 3 is a fragmentary view of the distributor mechanism shown in FIG. 2 in which the respective inboard and outboard sections are telescopically assembled.
Figure 4:
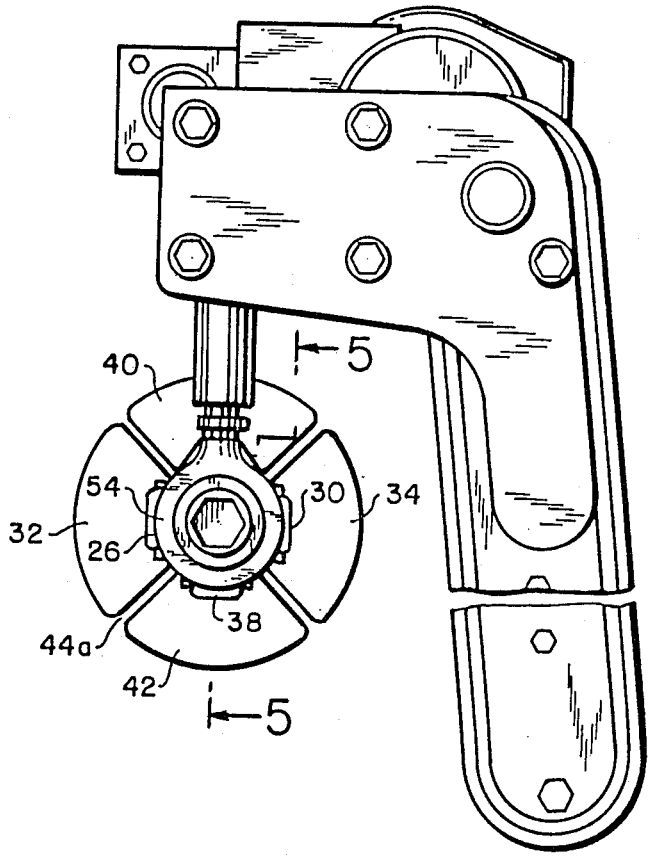
FIG. 4 is an end elevational view showing a distributor mechanism for a paving machine.
Figure 5:
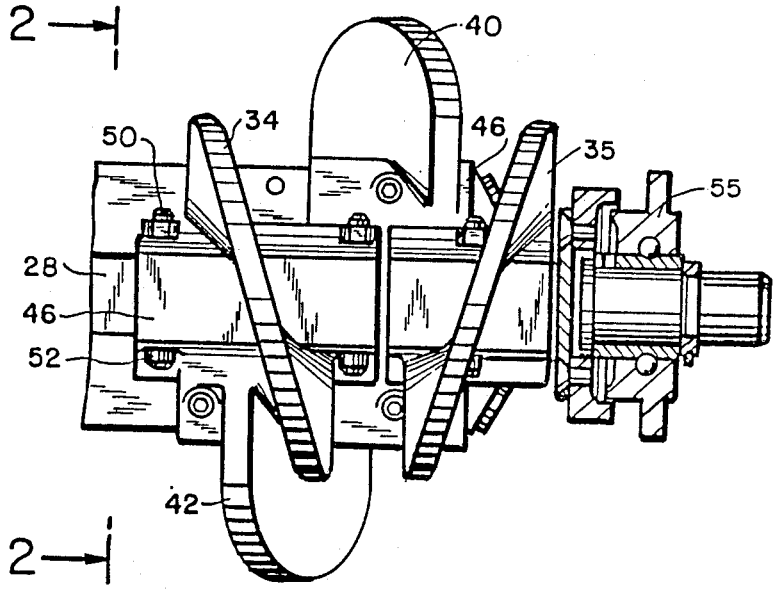
FIG. 5 is a sectional view in enlarged form taken along the lines 5—5 of FIG. 4.
Figure 6:
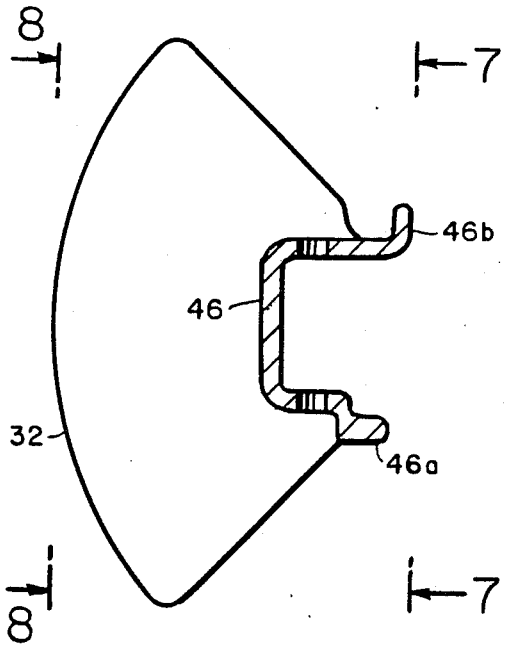
FIG. 6 is a partial sectional and a partial elevational view of a deflector plate of the power extendible distributor mechanism showing the tongue and groove bolt-on casting for removably affixing a deflector plate to a central drive mechanism.
Figure 7:
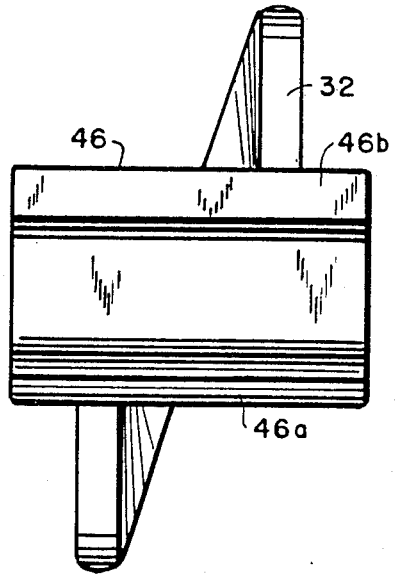
FIG. 7 is a view taken along the lines 7—7 of FIG. 6.
Figure 8:
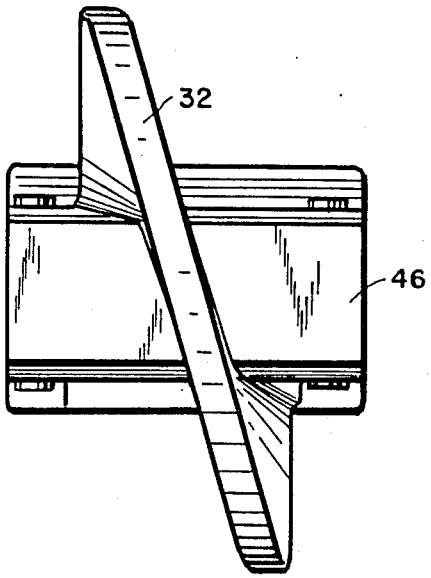
FIG. 8 is a view taken along the lines 8—8 of FIG. 6.
Figure 9:
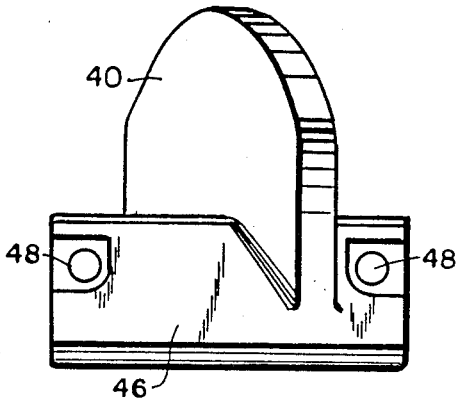
FIG. 9 is a front elevational view of a left hand paddle showing the channel-shaped casting for removable attachment to a central drive shaft.

As seen in FIGS. 2–5, the outboard distributor section 24 comprises tubular structural members 36 and 38 welded or otherwise secured to an end plate (not shown) and to a shaft 29 which telescopes within center tube member 28 in a plane at right angles to the mounting plane of tubular members 26 and 30. A cover shield 54 is shown in FIGS. 4 and 5 for the inner bearing assembly 55. The tubular structural members 36 and 38 slide along tube 28 in order to assume an extended position but are not attached to tube 28. Consequently, the outboard distributor section, when extended, is cantilevered with respect to the inboard distributor section 22. The outboard tubular structural members 36 and 38 mount the deflector plates or paddles 40 and 42, respectively, which are generally similar to the deflector plates 32, 34 of the inboard distribution section, except that deflector plate 40 is the end paddle of the outer section, while deflector plate 42 is a full length auger paddle of the outer section. In FIG. 3 it will be noted that the end casting 47 is shorter than the other castings. However, there is no change in effect by using the shorter casting on the auger.

It should be evident that the inboard and outboard distributor sections 22 and 24 have opposing deflector plates with a 90 degree rotational displacement so that the opposing deflector plates in one of the sections can be slid into and received in the open spaces 44 between opposing deflecting plates of the other section. When the outboard section 24 is fully retracted within the spaced deflecting plates of the inboard section, the auger configuration is that of a substantially continuous helix. As will be noted in FIG. 2, there is a clearance **44*a* between the adjacent edges of the deflector plates so that there is no interference between the deflector plates of the outboard and inboard sections 22 and 24**, respectively, during outboard telescoping and inward retracting movements thereof.

Contrary to the structure shown and described in my co-pending application Ser. No. 907,655, the deflector plates of both the inboard and outboard distributor sections 22 and 24 are provided with bolt-on castings 46 in the form of an inverted channel-shaped members, as clearly seen in FIGS. 6–9 of the drawings. Castings 46 are provided with holes 48 in the front and rear thereof through which bolts 50 can be inserted and nuts 52 affixed thereto, thus, removably securing each of the deflector plates to the respective tubular structural members adjacent thereto. Consequently, the inverted channel-shaped connecting members are interconnected to each other in a tongue and groove arrangement, as seen in FIG. 2. Thus, each of the channel-shaped connecting members are provided with an extension **46*a* which will push against flange 46*b* of the adjacent channel-shaped connecting member, while the other leg of each channel-shaped member is provided with a flange 46*b* which interconnects with the projection 46*a* of the adjacent channel-shaped member to form a tongue and groove interlocking construction about the entire assembly of tubular structural members. The tongue and groove arrangement also functions to assist in supporting any side loads exerted on the cantilevered portions of the two tubes 36 and 38 of the outboard distributor section 24**. It should be apparent that upon breakage of any individual deflector plates or paddle, in the present material distribution assembly, and the same can be removed from the distribution assembly and replaced rapidly and effectively with another paddle or deflector plate segment.

As seen in FIGS. 6–9, the replaceable paddle or deflector plate are each provided with an inverted channel member having one leg provided with an extension **46*a* while the other leg is provided with a flange 46*b*. The inverted channel 46 is also provided with aligned holes 48 through which a bolt and nut attachment is made to the respective outer and inner distributor section, especially structural members 26 and 30, as well as structural members 36 and 38. A central drive shaft 29 of the inboard sectin 22 imparts rotational movement to the outboard section 24 in any extended or retracted position of the outboard section by means of the driving connection between the rotating drive shaft 29 which closely interfits within the center rectangular-shaped tube member 28. As a result a drive means (not shown) may rotate both inboard and outboard telescoping distributor sections in either extended or retracted modes. In addition, the adjustable positioning of the outboard distribution section 24 relative to the inboard distribution section 22** is set forth in my copending application Ser. No. 907,655.

What is claimed is:

1. A telescoping auger-like material distribution device for road pavers and the like comprising:

(a) an inboard material distribution part, (b) an outboard material distribution part telescopingly connected with said inboard part, (c) deflector plate means removably mounted on each of said material distribution parts, (d) the deflector plate means of each material distribution parts being so arranged as to provide a laterally distributed deflector plate configuration in any extended or retracted position of said material distribution parts and, (e) wherein said deflector plate means are each provided with a tongue and groove arrangement interconnected with adjacent deflector plate means when said telescoping material distribution device is in its retracted position, or is partially extended.

2. A telescoping auger-like material distribution device as claimed in claim 1 wherein said material distribution parts includes a plurality of rectangular tubular structural elements, and said tongue and groove arrangement comprises a channel-shaped member provided with means for removably attaching said member to said rectangular tubular structural elements.

3. A telescoping auger-like material distribution device for pavers as claimed in claim 2, further comprising a driving shaft, and wherein said means are provided with spaced holes in said channel-shaped member, and aligned spaced holes in the adjacent rectangular structural elements for removably fixing said deflector plates to a center driving shaft member.

4. The deflector plate means as claimed in claim 1 which are removable from each of said material distribution parts wherein in the retracted position of said material distribution parts, each of which are provided with channels in which each of the legs of each channel are removably interconnected.

5. A telescoping auger-like distribution device for pavers as claimed in claim 4, wherein each of said channels are of identical configuration and in the retracted position, or partial retracted position of said material distribution device, all of said channels are interconnected, forming a plurality of deflector plates which are capable of rotating as a unit.

6. A removable deflector plate for use with a telescoping auger-like material distribution device for road pavers having inboard and outboard material distribution parts which are telescopically connected and provided with a rectangular-shaped drive member for at least one of said material distribution parts and comprising an helical segment of a circle constituting a deflector plate and covering an angle of approximately 90 degrees and having a connecting channel opening in a direction substantially perpendicular to the direction of extension of said deflector plate, and said channel provided with means for removably securing said deflector plate to said drive member.

7. A telescoping auger-like material distribution device for road pavers and the like comprising:

(a) at least one inboard auger-like section, (b) at least one outboard auger-like section telescopingly associated with said inboard section, (c) the plurality of deflector plate means carried by each of said auger sections covering an arcuate segment of approximately 180 degrees and being adapted to interfit when retracted to form a helical configuration, and (d) the deflector plate means of each auger-like section being so related to the deflector plate means when adjacent sections provide continuous material movement in any extended or retracted configuration of said auger-like sections and, (e) means for removably attaching said deflector plate means to at least one of said auger-like sections.

* * * * *